US009963902B2

(12) United States Patent
McGarrah

(10) Patent No.: US 9,963,902 B2
(45) Date of Patent: May 8, 2018

(54) EMERGENCY ACCESS SYSTEM FOR A STRUCTURE

(71) Applicant: Tony D. McGarrah, Inez, TX (US)

(72) Inventor: Tony D. McGarrah, Inez, TX (US)

( * ) Notice: Subject to any disclaimer, the term of this patent is extended or adjusted under 35 U.S.C. 154(b) by 0 days. days.

(21) Appl. No.: 14/622,240

(22) Filed: Feb. 13, 2015

(65) Prior Publication Data

US 2016/0237677 A1 Aug. 18, 2016

(51) Int. Cl.

| | |
|---|---|
| ***E04B 1/62*** | (2006.01) |
| ***E04H 9/14*** | (2006.01) |
| ***A62B 3/00*** | (2006.01) |
| *G08B 25/10* | (2006.01) |

(52) U.S. Cl.
CPC ..... *E04H 9/14* (2013.01); *A62B 3/00* (2013.01); *G08B 25/10* (2013.01)

(58) Field of Classification Search
CPC ... E04B 1/62; E04B 1/947; E04B 1/94; G08B 25/10; E04H 9/14; E04G 23/08
See application file for complete search history.

(56) References Cited

U.S. PATENT DOCUMENTS 3,120,032 A * 2/1964 Burnette ..... E05B 65/1033 292/92
4,164,095 A * 8/1979 Musacchia ..... A62C 2/12 182/19
4,270,311 A * 6/1981 Palomar ..... E05B 65/1033 292/218
4,468,886 A * 9/1984 Tew ..... E05B 65/1033 49/141
5,103,591 A * 4/1992 Szymanski ..... A62B 5/00 49/141
D374,486 S * 10/1996 Guin ..... D25/48.3
5,726,637 A * 3/1998 Miyahara ..... G08B 29/16 169/23
7,650,723 B1 * 1/2010 Kotlarich ..... E04D 13/00 49/141
2004/0163325 A1 * 8/2004 Parrini ..... B66B 5/022 52/1

* cited by examiner

*Primary Examiner* — Joshua J Michener
*Assistant Examiner* — Keith Minter
(74) *Attorney, Agent, or Firm* — Edward L. White; Kerry Green

(57) ABSTRACT

An emergency access system comprising a structure having therein at least two rooms with at least one common wall between them and an exterior wall, at least one bi-directional access opening defined in at least one selected from an exterior wall and common wall, a sheet of material with a bi-directional breakaway panel sized to substantially fill the access opening, the sheet affixed and in-line to at least one wall, the breakaway panel is a double panel, one panel on each side of an internal framed structure allowing entry from either room, and at least one bi-directional breakaway mounting fastener retaining each panel within each opening and, under pressure, breakably releasing the panel whereby an access opening enables a person in an emergency to release the breakaway mounting panel by applying pressure to the panel, thus allowing emergency access.

13 Claims, 6 Drawing Sheets

EMERGENCY ACCESS SYSTEM FOR A STRUCTURE

CROSS-REFERENCE TO RELATED APPLICATIONS

None.

FIELD OF THE INVENTION

The invention generally relates to emergency access systems for structures. More particularly, the invention relates to systems and methods for ingressing and egressing a structure during an emergency allowing the rescuers to easily enter the structure or trapped personnel to easily exit.

SUMMARY OF THE INVENTION

The invention relates to a system of breakaway panels that allows persons in emergency situations who are prevented from exiting using the normal avenues of escape to reach safety or rescuers who are prevented from reaching such persons through normal avenues within the structure to reach them. More particularly, the invention relates to a system of breakaway panels enabling a person in an emergency to create an escape opening by striking or applying pressure to the breaking away panel in the room and if present, the adjoining break away panel on the opposite wall of the adjacent room thus creating a pathway from one room to another allowing movement between rooms toward an emergency exit. The System may automatically notify a monitoring station through sensors that a panel is penetrated and rooms walls has been breached.

In structures with multiple adjacent rooms or multiple floors such as hotels, motels, apartment buildings, and commercial office buildings the emergency exits and escape routes are usually well marked and identified with signage so a person can reach these routes and exits. However, there are situations where these routes and exits may be blocked. For example, a person rents a room in a motel with the air conditioner installed under the only window in the room and next to the only door. If the air conditioner were to catch on fire, the person staying in that room would have no reasonable means of escape without injury and would likely die due to smoke or fire. This is not an uncommon scenario in these types of structures as can be seen in many news reports citing persons being trapped by the fire or unable to escape due to the smoke. Additionally, in these situations, the injury and death tolls are usually greater when the room is on an upper floor or level where the only option may be to jump and suffer serious injury or even death.

Furthermore, with an increased number of school shootings, the teachers and students are locked in their respective rooms, effectively placing them alone waiting for help to arrive once the teacher has locked the door. There is typically only one way into the classroom and if the shooter enters through the door, the children and teacher have no reasonable means of escape nor do they have the ability to defend themselves since each classroom usually contains only a single unarmed adult to fend off the attacker.

U.S. Pat. No. 3,120,032 to Burnette, teaches a reusable escape hatch/door with extensive frame structure, a complicated latching mechanism, and a unidirectional door/hatch where the door/hatch may be opened or removed. Additionally, the design would be bulky and heavy based on the components selected and the overall structure.

U.S. Pat. No. 4,270,311 to Palomar, teaches a reusable escape hatch for dwellings and mobile homes that consists of a panel fitted within the external wall opening that is maintained in place by latch assemblies that engage the wall. This escape panel allows a person trapped inside a dwelling to quickly exit the building if they are located in a room that has the escape hatch. Additionally, Palomar suggests the panel being operationally interconnected to a burglar alarm to notify of unauthorized access.

U.S. Pat. No. 4,468,886 to Tew, teaches a wall mountable safety hatch with a pair of door frames that fit within the current structure to create the opening and a pair of doors that fit within the door frames with a strap and cinching device to maintain the doors in place.

U.S. Pat. No. 7,650,723 to Kotlarich, teaches an egress system that allows a person to exit the interior of the structure through a hatch panel in the roof of a home. The design consists of a metal frame that creates an opening and a hatch panel that is secured in the frame with releasable fasteners. Additionally, shingles are placed over opening and attached to the hatch panel to make the roof look uniform without any outward signs of a hatch panel. Gaps are placed between the mounting frame and the hatch panel to allow for a tool to cut the shingles in order to remove the hatch panel and provide an exit to the roof.

The prior art has concentrated on moving persons from the interior of the building to the exterior and to safety. Additionally, each of these designs consists of three basic components: a frame, a door or doors and a mechanism for maintaining the doors in place. These components add weight, cost, and complexity. Furthermore, the weight and complexity may prevent a person that is smaller is stature, older, handicapped or a child, to be able to effectively escape in an emergency.

Each of these designs with the exception of Kotlarich is not integrated with the structure's design thus making it unsightly and compromising the aesthetics of the interior of the building. These aesthetics are very important to businesses such as hotels, motels, office buildings, and to government building such as schools. Additionally in schools, children may be more apt to want to play with the device if it is obvious to them thus possibly damaging the device and preventing its use during an escape.

All the designs add significant costs and complexity to the building where they are installed and it would not be practical to install in every room within a structure. Additionally, these designs do not address the need to move from room to room in the case of an active shooter, whereas the present design is a one-time use that is easily and cheaply replaced.

The present invention overcomes these shortcomings by providing a low cost method that fully integrates the Emergency Access System (hereinafter "System") design into the current wall structure in a building, seamlessly without any visible signs unless so desired. This design allows persons to move from room to room within a building until reaching a designated exit area that leads to the outside of the building or where persons are gathered for mutual protection as in a school. The design is a bidirectional design allowing persons to exit a room and also allowing rescuer's another way to easily enter a room and reach persons that may be trapped. The System design is minimal thus overcoming the prior art's design that were complex and cumbersome requiring significant additional materials and adding weight. Moreover, this design allows persons that are smaller in stature, older, children, or handicapped to be able to effectively escape in an emergency.

The present invention solves the problems identified above by offering a disposable bidirectional System. The present invention fulfills the industry's need for an alternative method of escaping from a room in an emergency such as fire or allowing teachers to move the children to either safety or a place them in a more secure environment where more than one adult may be able to resist the shooter and protect the children.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
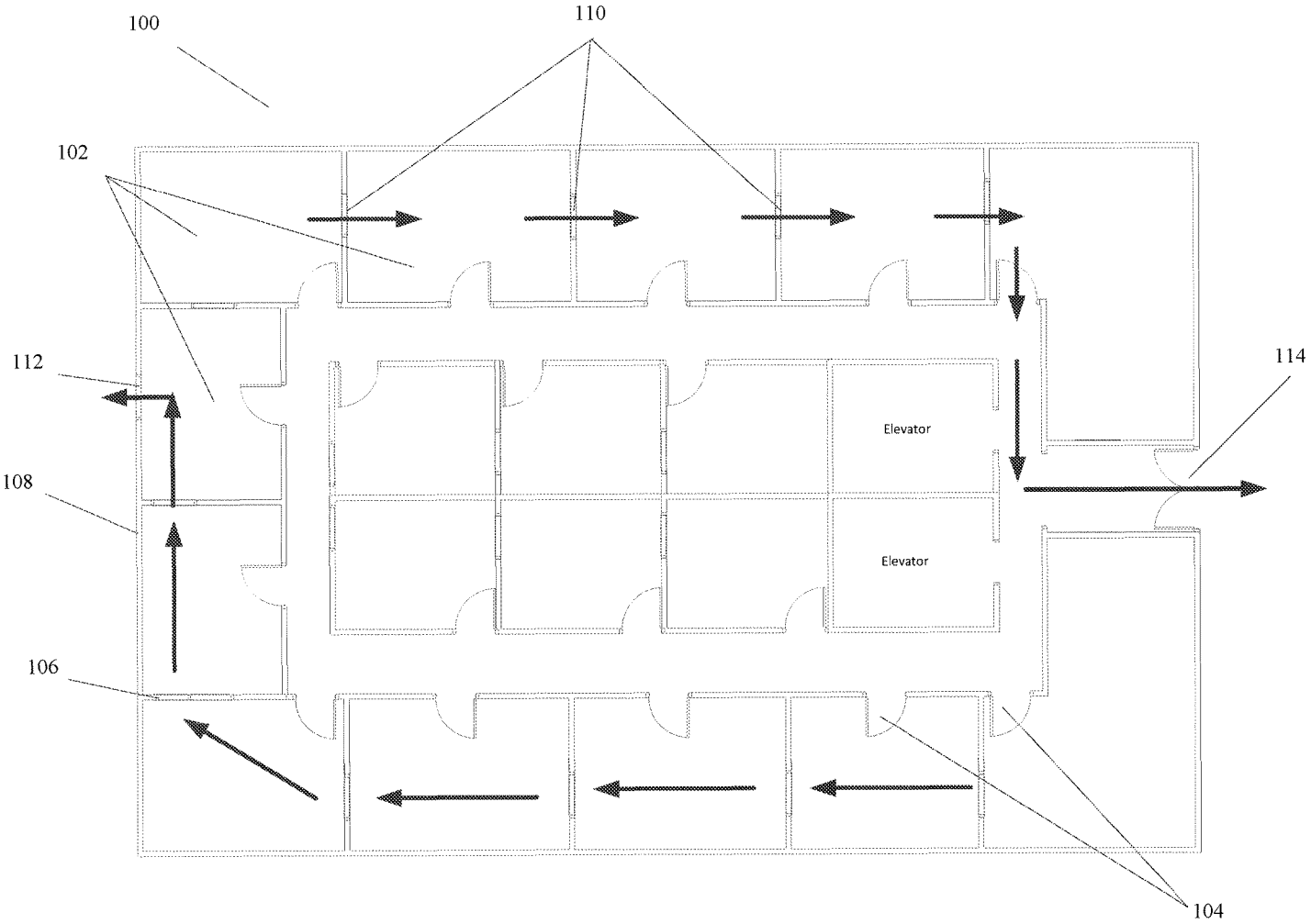
FIG. 1 is a floor plan view of a generic structure with the System installed.

FIG. 1 is a floor plan view 100 of a generic building floor plan representing a multitude of building types such as a hotel, motel, office, or school where the System may be installed. The floor plan is not limited to these specific types of building but may further include other buildings such as commercial, residential, and industrial buildings where there may be a multitude of rooms with common walls.

The floor plan view 100 illustrates the internal structure of a building that may include the following: rooms 102, doors 104, common walls 106, exterior walls 108, and an entrance/exit that functions an emergency exit 114. Illustrated in this floor plan view 100 is the installed System having a multitude of interior access portals 110. These multiple interior access portals 110 allow a person to penetrate a common wall 106 from the current room and enter into the adjacent room. This access enables a person to move freely from room to room whenever the use of their door 104, their normal exit, is blocked and they are prevented from escaping because of some type of emergency such as a fire, building material collapse, or an active shooter.

Additionally, this floor plan view 100 shows a single exterior access portal 112, however, multiple exterior access portals 112 may be installed depending on the building design, local building codes, costs, occupant's requirements, and the exterior building covering. The exterior access portals 112 allow people that are trapped and cannot reach a designated emergency exit 114 another means to exit the building and escaped unharmed. Emergency exits 114 are typically used by people escaping the building but the System may allow other entry and exit points into the building.

Rescue personnel may find upon reaching the scene that they are unable to enter through the designated emergency exit 114 because an active shooter may have chained the door lock and the police may not have the appropriate tools to breach the door or it is deemed too risky to attempt to enter. The System may enable the rescuer's to enter the building from exterior access portals 112 points along the exterior wall 108 rather than risk breaching emergency exits 114 or some other exterior exits. Furthermore, multiple exterior access portals 112 may allow rescue personnel to reach people that are trapped in a more expedient and efficient manner and in the case of an active shooter would allow the rescue personnel to enter the building at places that would be unexpected by an active shooter.

Figure 2:
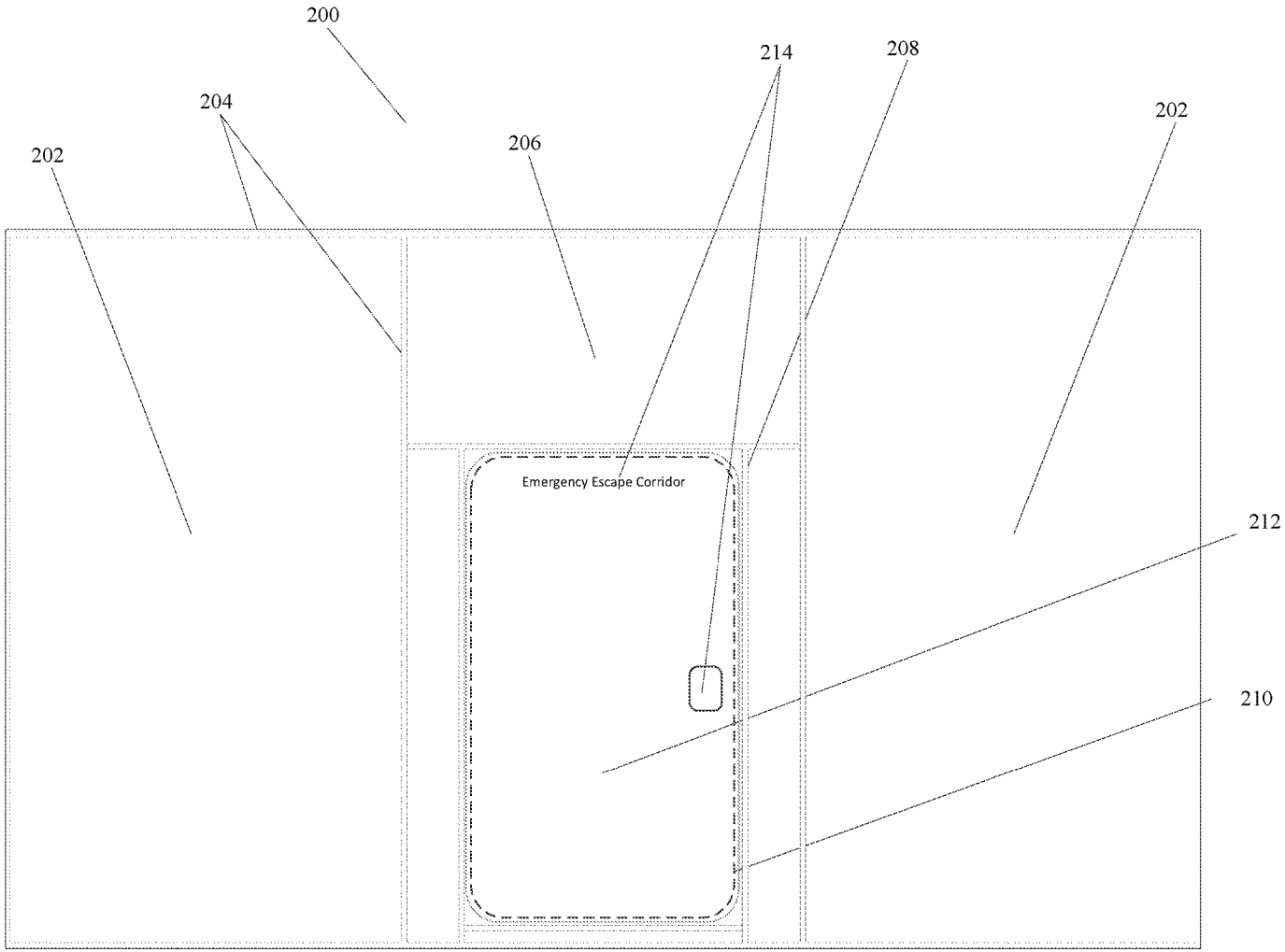
FIG. 2 is a detailed view from the room's interior of a wall with the emergency access system installed.

FIG. 2 is a detailed view from the room's interior 200 of a common wall 106 with System installed. This view is from inside a room looking at a common wall 106 between two rooms. The common wall 106 may be constructed using standard wall construction techniques known by one skilled in the art utilizing wood or metal studs for the interior wall structure 204 but is not limited to these specific types of construction methods and materials. Additionally, the interior wall structure 204 may be covered by a wall material, which is typically drywall but one skilled in the art may choose other materials such as plaster and lath, oriented strand board, plywood, paneling, fiber board, plastic, foam, concrete, and metal but is not limited to these materials. In a preferred embodiment, the common wall 106 consists of a wooden interior wall structure 204 with the standard wall panels 202 utilizing drywall material, placed on either side of the wooden interior wall structure 204 and attached thereto. This preferred embodiment allows for easy installation of the emergency access sheet 206 between standard wall panels 202. The interior wall structure 204 is further illustrated in FIG. 4 below.

Each interior access portal 110 preferably includes emergency access sheets 206 installed on both sides of the structure 208. Each emergency access sheet 206 may contain an bi-directional emergency access opening 210 wherein the bi-directional breakaway panel 212 substantially fills the opening 210 where it is releasably retained within the opening 210.

Installation of the System may require removal and replacement of standard wall panels 202 with emergency access sheet 206 containing the bi-directional breakaway panels 212 in existing structures but may not require removal in new construction. The emergency access sheet 206 on one side of the common wall 106 should directly oppose the companion panel on the other side of the common wall 106 thus aligning the bi-directional emergency access openings 210. Unlike a door, which is designed to repeatedly open and close to allow access, the breakaway panels are retained in a fixed position, but can be broken loose from their mounts by pressure of a user. Once broken, repairs must be undertaken to re-establish the panel in a fixed position.

Additionally, a repositioning of some components of the interior wall structure 204 may be needed in retrofitting an existing wall in order to allow personnel to more easily pass between the two rooms 102. By repositioning and adding components to the frame structure, the original interior wall structure 204 becomes the emergency access panel structure 208. This structure allows the panel to be more easily penetrated and broken by reducing the flexibility of the panel making it more susceptible to being penetrated in an emergency. In the preferred embodiment, the emergency access sheet 206 is placed between two standard wall panels 202 wherein one skilled in the art would finish the wall using the normal construction processes including taping and mudding to hide the seams, texturing of the walls and painting.

Another feature of the System, is the ability to replace a standard wall panel 202 but maintain the aesthetics so it could be used in buildings such as hotels, motels, office buildings and government buildings while also providing an easy way for persons to exit the area in an emergency without having to go through the normal exit in the event that it is blocked. The aesthetics of the room with the emergency access sheet 206 should be the same or similar compared to a room without the sheet 206 and only the structure within the emergency access sheet 206 should be different. Additionally, if desired, the bi-directional breakaway panel 212 may be marked with access markings 214 indicating the existence of the bi-directional emergency access opening 210 and the location of the bi-directional breakaway panel 212. Simple instructions such as "press firmly to open" may be marked on the bi-directional panel 212

Figure 3:
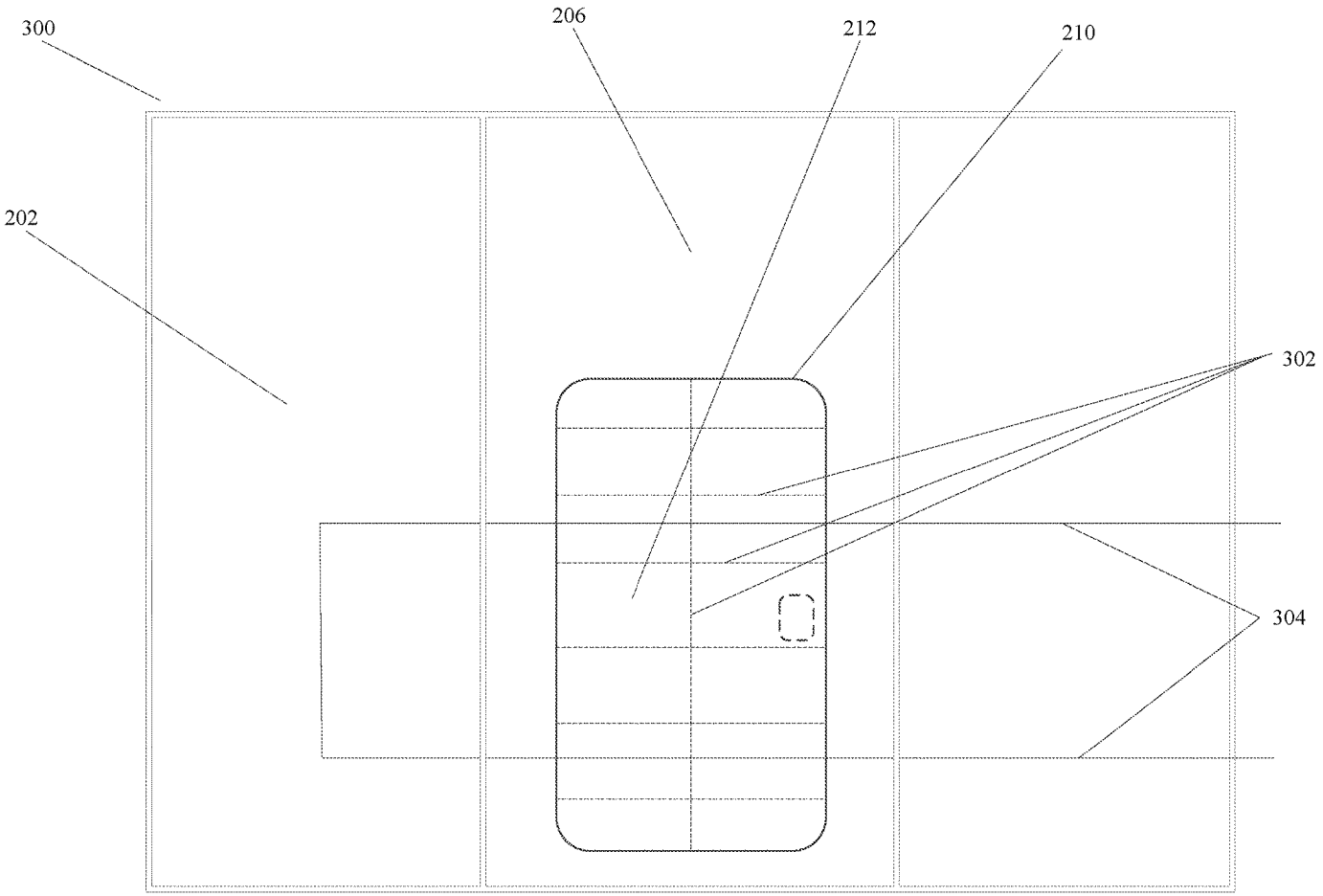
FIG. 3 is a detailed view of the interior wall structure with the System installed.

FIG. 3 shows the interior wall structure 204 and emergency access panel structure 208 between two rooms with the standard panels 202 and emergency access sheet 206 removed from one side of the wall. This view illustrates a preferred embodiment utilizing 2-by-4 wood construction to create a frame using the emergency access panel structure 208 outlining the bi-directional emergency access opening 210 wherein a standard wall panel 202 consisting of drywall material is placed on either side of the emergency access sheet 206. The emergency access panel structure 208 may be wooden or metal but is not limited to these materials, will be apparent to one skilled in the art. The view further illustrates the scoring 302 of the bi-directional breakaway panel 212, and the sensors 304.

The bi-directional breakaway panel 212 may be scored 302 on the inside of the wall. The scoring may be done both vertically and horizontally to such a depth that when pressure is applied from the room's interior 200 it will release revealing an opening into the next room. The bi-directional breakaway panel's 212 remaining material acts as a breakaway mounting fastener for retaining each panel within each opening. Scoring 302 is but one method that may be used to allow this opening to be quickly penetrated. Other methods include cutting bi-directional breakaway panel 212 out of the emergency access sheet 206 and then re-installing the bi-directional breakaway panel 212 with fasteners that allow it to be quickly penetrated. Other methods may be used by one skilled in the art that would be appropriate for the type of material utilized but is not limited to the method of scoring.

Additionally, in the preferred embodiment of the invention, sensors 304 may be connected to a monitoring system 500, which notifies personnel when the wall has likely been penetrated. In the present embodiment invention, the sensor 304 is a continuity sensor that is hardwired to the monitoring station and alarms whenever continuity is broken. Continuity is defined as a continuous circuit that provides an electrical path for current to flow wherein a break in the path disrupts the flow and the sensors detect the interruption. However, the sensor may be wirelessly connected to the monitoring station to ease retrofitting a structure. The continuity sensor is installed such that penetration of the wall should cause the wires to disconnect and opening the circuit thus giving an indication to the monitoring system 500 and the monitoring station 502. Other methods of sensing and detecting the penetration of the walls including light, motion, vibration, temperature, electric fields, and sound, but is not limited to these methods of detection and sensing will be apparent to one skilled in the art.

Figure 4:
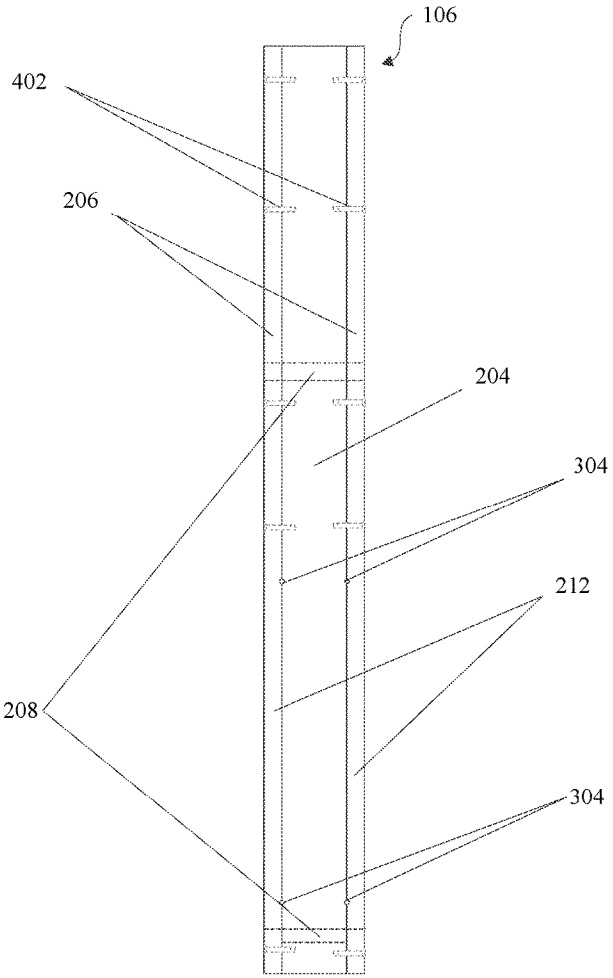
FIG. 4 is an end view of a common wall with the System installed on both sides.

FIG. 4 shows a cross-sectional view of a preferred embodiment of a common wall 106 with the System installed. This view illustrates emergency access sheets 206 affixed on both sides of the common wall 106 using fasteners 402 connecting to the emergency access panel structure 208 and the interior wall structure 204. Typically, the fasteners 402 used to attach drywall are drywall screws. However, the panels 202 and sheet 206 may be attached by other methods including but not limited to nails, clips, adhesives, and other methods of attachment that will be apparent to one skilled in the art.

Additionally, the sensors 304 are shown installed behind the bi-directional breakaway panel 212 in the upper and lower portions of the bi-directional panel 212. The placement of the sensors may be determined by one skilled in the art based on factors such as the type of sensor used, false alarm rate, and likelihood of detection after penetration.

Figure 5:
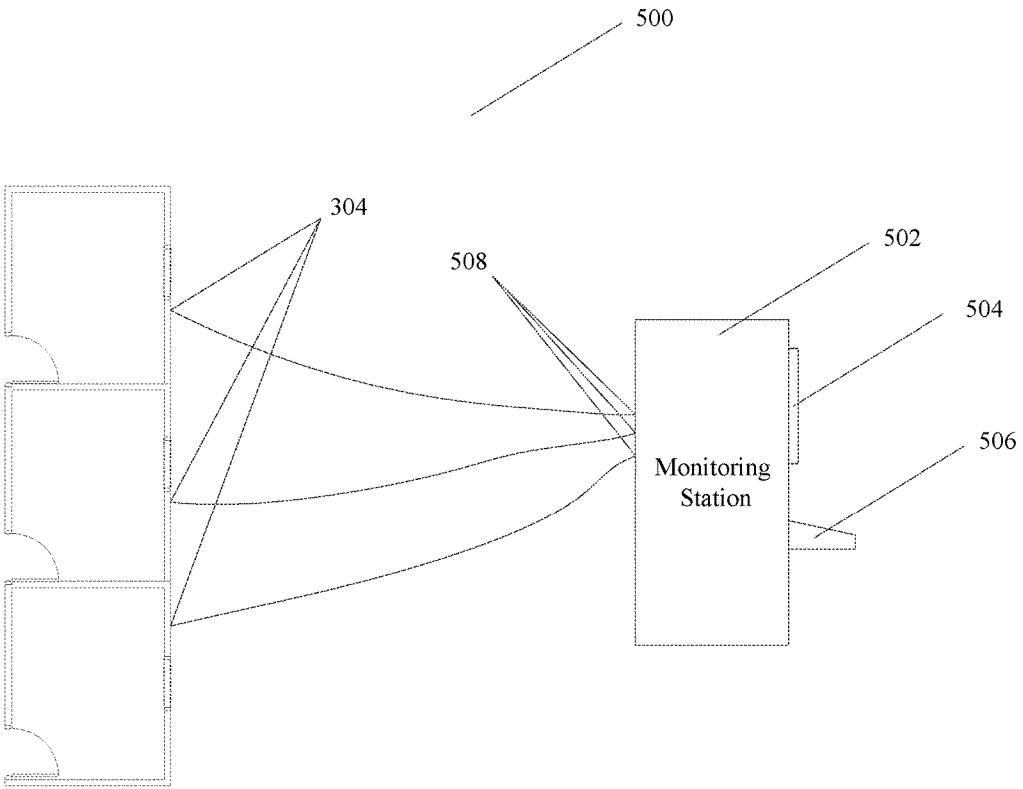
FIG. 5 shows a monitoring station connected to wall sensors.

FIG. 5 depicts a monitoring system 500 that may consist of a monitoring station 502, monitoring station sensor connections 508, which connect to the sensors 304, a display 504, and a user interface 506. The monitoring station 502 preferably includes a microprocessor to communicate with the sensors, display, and user interface. One skilled in the art may use analog devices, a microcontroller, and a programmable logic controller to sense, display the data, and allow for user interaction but is not limited to these specific devices and methods. The monitoring system 500 may preferably allow the monitoring station 502 to detect a penetration of a bi-directional breakaway panel 212 and show on the display 504 the room and the wall within the specific room where the bi-directional breakaway panel 212 has been penetrated. The display 504 may be selected from audio and visual display, which may provide an immediate indication to monitoring personnel that a wall has been penetrated. A user interface 506 may allow the operator to interact with the monitoring station 502 by transmitting user inputs to the monitoring station. Both the user interface 506 and the display 504 may be integrated into a remote device that communicates wirelessly with the monitoring station 502, thus enabling rescue personnel to be outside the structure when viewing the display and identifying the location of the penetration.

Figure 6:
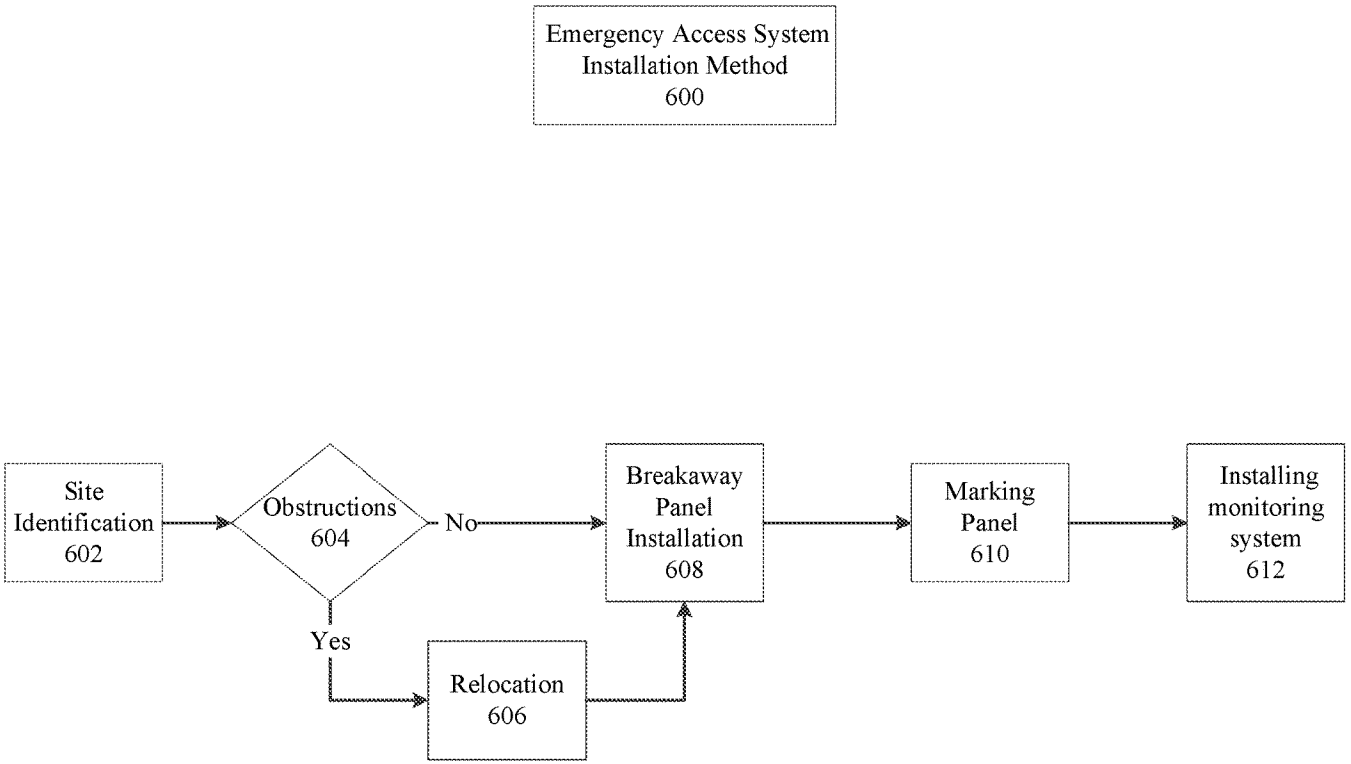
FIG. 6 is a flow diagram illustrating a process for installing a System.

FIG. 6 illustrates the System installation method 600 for the preferred embodiment of this invention, which may include the following steps: site identification 602, obstruction identification 604, relocation of obstructions 606, emergency access panel installation 608, emergency access panel marking 610, and monitoring system 612 installation. This installation method 600 may be used for new construction or to retrofit existing structures.

A site identification step 602 evaluates the suitability of the site considering the requirement of movement from room to room. Placement of furniture and access to the existing exits are factors that may be considered in determining to proper placement. Other factors may be used by one skilled in the art that would be appropriate for determining the proper placement but is not limited to furniture location and existing exits.

Obstruction identification 604 may follow the identification step. After the identification of a proposed site is completed, obstructions within the interior of the wall need to be identified wherein the obstructions such as electrical, structural, ventilation, and plumbing may preclude installing an emergency access sheet 206. If there are obstructions, then another site may be chosen or the obstructions may be removed or relocated outside the suitable area depending on the nature of the obstruction Relocation 606 may depend on the obstruction involved. If the obstruction is structural in nature then the overall structure may be modified to remove the obstruction while maintaining the structural integrity of the wall. If the obstruction is plumbing, electrical, or heating and air, then those obstructions may be relocated or rerouted to allow the System to be installed.

The System installation 608 may consist of adding emergency access panel structure 208, if required, then affixing the emergency access sheet 206 to the structure 208 by fasteners 402.

This additional structure 208 allows the panel to be more easily broken in the event of an emergency. Once the structure 208 has been put in place then the sensors 304 are added and emergency access sheet 206 are installed over the openings in both rooms covering the sensors and allowing for a common portal between the rooms once the walls have been penetrated. After the installation of the emergency access sheet 206, the sheet 206 may be covered by common wall finishing techniques such as texturing and painting. Other methods of covering walls to make them aesthetically pleasing including but is not limited to texturing and painting will be apparent to one skilled in the art. After the wall covering is complete, a person may desire to provide visual indications where to penetrate the wall.

Marking panels 610 allows a person inside a room to know where another emergency exit exists. Marking Panels 610 may be accomplished by providing a visual indication on the emergency access sheet 206, the floor in front of the panel or in documentation that remains in the room in the case of a hotel or motel. The preferred embodiment includes placing the words "Emergency Escape Corridor" or similar wording at the top of the bi-directional breakaway panel 212 and outlining the panel. Other methods for visual indication include the above mentioned locations and manners but is not limited to these and will be apparent to one skilled in the art.

After completing the above steps, which is not an inclusive set of steps, the monitoring system 500 may be installed in a desired location and the sensors are connected to the monitoring station sensor connections 508. The monitoring station 502 may be programmed to display user defined messages. After installation, the monitoring station 502 may be monitored by personnel wherein they are alerted when a wall has been breached.

The purpose of the abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

While the invention has been shown, illustrated, described and disclosed in terms of specific embodiments or modifications, the scope of the invention should not be deemed to be limited by the precise embodiments or modifications therein shown, illustrated, described or disclosed. Such other embodiments or modifications are intended to be reserved especially as they fall within the scope of the claims herein appended.

Having thus described the invention, I claim:

1. An emergency access system comprising:

a. a structure having therein at least two rooms with at least one common wall between the rooms and an exterior wall;

b. at least one bi-directional access opening defined in at the least one selected from an exterior wall and common wall;

c. a sheet of material with a bi-directional breakaway panel sized to substantially fill the bi-directional access opening, the sheet affixed and in-line to at least one wall;

d. the bidirectional breakaway panel is a double panel, one panel on each side of an internal framed structure in the at least one selected from exterior and common wall allowing entry from either room; and e. the sheet of material wherein the bi-directional breakaway panel is defined by scoring the interior sides of the sheet, thus creating the bi-directional breakaway panel releasably affixed to each wall, whereby a person striking the bi-directional breakaway panel reveals the bi-directional access opening created in the sheet and the common wall, enabling a person in an emergency, to move to the adjacent room through the created opening.

2. The system of claim 1, where the wall material is selected from at least one of a group consisting of drywall, plaster and lath, oriented strand board, plywood, paneling, fiber board, plastic, foam, concrete, brick, veneer, and metal.

3. The system of claim 1, wherein a room side of the wall is marked indicating the existence of a breakaway emergency access opening.

4. The system of claim 1, where at least one opening is in communication with a sensor relaying information to at least one monitoring station when the breakaway panel is released.

5. The system of claim 4, where the monitoring station is selected from analog, a microprocessor, a microcontroller, and a programmable logic controller.

6. The system of claim 4, including at least one sensor selected from light, motion, vibration, circuit continuity, temperature, electric fields, and sound, each sensor in communication with the monitor station.

7. The system of claim 6, where the sensor communicates wirelessly with a monitoring station.

8. The system of claim 4, wherein a monitoring station further comprises a display and user interface displaying at least one sensor status.

9. The system of claim 4, where a monitoring station wirelessly communicates with a remote device displaying the sensor inputs and receive user inputs.

10. The system of claim 1, wherein an internal framed structure is affixed to the inside of the wall around a perimeter of the opening to assist with penetration by reducing the flexing of the wall material causing the material to more easily break.

11. An emergency access system comprising:

a. a structure having therein with at least two rooms having at least one common wall between rooms;

b. at least one bi-directional access opening defined in the at least one common wall;

c. a sheet of material with a bi-directional breakaway panel sized to substantially fill the bi-directional access opening, the sheet affixed and in-line to at least one wall;

d. the bidirectional breakaway panel is a double panel, one panel on each side of the internal framed structure in the at least one and common wall allowing entry from either room;

e. the sheet of material wherein the bi-directional breakaway panel is defined by scoring the interior sides of the sheet, thus creating the bi-directional breakaway panel releasably affixed to each wall;

f. at least one sensor adapted to create an alarm condition upon at least one panel being released; and g. a monitoring station in communication with each sensor, whereby a person striking the bi-directional breakaway panel reveals the bi-directional access opening created in the sheet and the common wall, enabling a person in an emergency, to move to the adjacent room through the created opening and signaling the opening has been breached.

12. The system of claim 11, wherein an internal framed structure is affixed to the inside of the wall around a perimeter of the opening to assist with penetration by reducing the flexing of the wall material causing the material to more easily break.

13. The system of claim 11, wherein the breakaway panel is a double panel, one panel on each side of an internal framed structure allowing entry from either room.

* * * * *